US005836808A

United States Patent [19]

Sawafuji et al.

[11] Patent Number: 5,836,808

[45] Date of Patent: Nov. 17, 1998

[54] SLICING MACHINE WITH BUILT-IN GRINDER

[75] Inventors: Susumu Sawafuji; Nozomi Takai, both of Mitaka, Japan

[73] Assignee: Tokyo Seimitsu Co., Ltd., Tokyo, Japan

[21] Appl. No.: 667,791

[22] Filed: Jun. 21, 1996

[30] Foreign Application Priority Data

Jun. 30, 1995 [JP] Japan ..... 7-186711

[51] Int. Cl.[6] ..... B24B 27/06; B24B 7/22

[52] U.S. Cl. ..... 451/70; 451/461; 125/13.02

[58] Field of Search ..... 451/69, 70, 461, 451/462, 271, 57; 125/13.02, 23.01

[56] References Cited

U.S. PATENT DOCUMENTS 4,894,956 1/1990 Honda et al. ..... 451/70

FOREIGN PATENT DOCUMENTS

| | | |
|---|---|---|
| 0313714 | 5/1989 | European Pat. Off. . |
| 2469259 | 5/1981 | France . |
| 61-106207 | 5/1986 | Japan . |
| 1-115604 | 5/1989 | Japan . |
| 1-210313 | 8/1989 | Japan . |
| A -1-210313 | 8/1989 | Japan . |
| B2 -2-12729 | 3/1990 | Japan . |
| A -4-71688 | 3/1992 | Japan . |
| 6-15634 | 1/1994 | Japan . |

*Primary Examiner*—Robert A. Rose
*Attorney, Agent, or Firm*—Oliff & Berridge, P.L.C.

[57] ABSTRACT

The rotational center of a grinding wheel is eccentric to a slicing side in a slice feed direction with regard to the rotational center of an inner diameter saw. As a result, the diameter of the grinding wheel can be smaller, and the slice movement distance of the ingot can be shorter. Therefore, it is possible to provide a low-priced slicing machine with built-in grinder wherein a slicing time is short and the grinding face is accurate.

7 Claims, 5 Drawing Sheets

SLICING MACHINE WITH BUILT-IN GRINDER

BACKGROUND OF THE INVENTION

1. Field of the Invention

The present invention relates to an inner diameter saw slicing machine with built-in grinder, wherein a grinding wheel is added to an inner diameter saw slicing machine which slices an ingot by moving a table supporting the ingot and a rotary blade relatively close to each other, and more particularly to a position where the grinding wheel is attached.

2. Description of the Related Art

An inner diameter saw slicing machine manufactures a wafer of a predetermined thickness by moving an ingot such as silicon, which is a material for a semiconductor element, relatively close to a point of a rotary ID blade (referred to as "a blade" in this specification).

In this case, the blade rigidity in a spindle direction is low, so a slice resistance increases due to the kerf wear, and there is the sludge between the ingot and the blade, and the like, as the slicing proceeds. Therefore, the blade kerf is easily displaced from its original position. As a result, both sides of the sliced wafer are bowed in many cases.

In a process of manufacturing the semiconductor element, a high plane accuracy is required for the wafer. Therefore, the lapping, etc. are performed for both sides of the wafer in the after-processing. However, the wafer is thin, so it takes much time for the lapping, etc. if both sides of the wafer are bowed.

In order to solve the above-mentioned problems, an applicant of the present invention has disclosed in a Japanese Patent Publication No. 2-12729 (Wafer Manufacturing Method) a slicing machine with built-in grinder, wherein a grinding wheel is added to the slicing machine, and which slices an ingot while grinding an ingot cutting face. The applicant of the present invention has also disclosed a support mechanism of the grinding wheel in a Japanese Patent Application Laid-open No. 1-210313 and a Japanese Patent Application Laid-open No. 4-71688.

The inner diameter saw slicing machines with built-in grinder are classified into vertical and horizontal ones according to how the ingot is attached. FIG. 5 shows an example of a vertical inner diameter saw grinding machine with built-in grinder.

In FIG. 5, the manufacturing part in the inner diameter saw slicing machine with built-in grinder is constructed in the following manner.

A table 4 is supported by a table guide 2, which is provided on a top of a base 1, in such a manner to move freely in directions a and b. A column 5 is attached to the table 4. A work holder 7, which is supported by a vertical guide in the column 5 in such a manner to move freely in a direction Z, is driven by a drive mechanism which is built in the column 5.

In the manufacturing part 10 next to the table guide 2, a tension head 13 is supported by a rotation mechanism. A blade 14 is tensioned by a top ring 15 and is attached to the tension head 13. An inner diameter saw 14a is formed at the inner diameter of the blade 14.

Furthermore, a hollow portion is formed in the main spindle which rotatively supports the blade 14. A grinding wheel 28 is secured to a wheel spindle, which is provided through the hollow portion, in such a manner to move vertically and rotate. A cup-shaped wheel face 28*a* is formed on the top of the grinding wheel 28. The grinding wheel 28*a* is positioned down from the inner diameter saw 14*a* by the thickness of the wafer. The support mechanism for the grinding wheel 28 in this example is disclosed in a Japanese Patent Application Laid-open Nos. 1-210313and 4-71688.

Incidentally, an inner cover 18 is fixed at the base 1 in the tension head 13.

In the inner diameter saw slicing machine with built-in grinder, which is constructed in the above-mentioned manner, the blade 14 is rotated at a high speed. An ingot W is moved in a direction Xa from a substantially central position of the blade 14 by the table 4 in such a state that a cutting face of the ingot W is positioned down from the inner diameter saw 14*a* by the thickness of the wafer, so that the ingot W is sliced. The ingot W is ground by the wheel face 28*a* of the grinding wheel 28 prior to being sliced by the inner diameter saw 14*a*. That is, the ingot W is sliced while the end face of the ingot is being ground.

As a result, a wafer, which has a fine plane at the end face thereof, can be obtained. If a plane accuracy of one side is satisfactory, a time required for an after-process such as lapping can be reduced dramatically.

Incidentally, when the sliced wafers are collected, the grinding wheel 28 moves in a downward direction so as not to interfere with a wafer collection saucer, which holds the wafer in a collection mechanism.

The rotational center of the grinding wheel 28 corresponds to that of the inner diameter saw 14*a*. A relationship between a diameter of the inner diameter saw 14*a*, a diameter of the grinding wheel 28, and an initial position of the ingot W is determined in the following manner.

This is explained with reference to FIG. 4. FIG. 4(*a*) is a plane view, and FIG. 4(*b*) is a section view thereof.

First, a diameter C of the inner diameter saw 14*a* for the collection saucer and its support spindle to pass through is determined by a diameter A of the ingot W and the length B in FIG. 4(*a*) a direction of a slice base, so that the wafer have been sliced can be collected.

Next, an opening δ between the grinding wheel and the wheel face 28*a* in the radius direction is set, so that a diameter Db (=C−2δ) of the grinding wheel 28 can be determined.

Furthermore, a value γ, which is larger than a width t in the radius direction of the grinding wheel 28 and the wheel face 28*a*, is set. Then, the initial position of the ingot W is determined so that a slicing start point Wa can be positioned inwardly from an outer diameter face of the grinding wheel 28 by γ.

As a result, a slicing movement distance Eb of the ingot W is calculated by the following equation:

$$Eb=B+\delta+\gamma$$

In this equation, γ is almost automatically set by the width t in the radius direction of the wheel face 28*a* of the grinding wheel 28. So, the slicing movement distance Eb is determined by the opening δ in the radius direction of the inner diameter saw 14*a* and the grinding wheel 28.

In the conventional mechanism, however, the rotational center of the grinding wheel 28 corresponds to that of the inner diameter saw 14*a* in the conventional mechanism. That is why the diameter Db of the grinding wheel 28 should be made large in order to reduce the opening δ in the radius direction of the inner diameter saw 14*a* and the grinding wheel 28.

However, in order that the diameter Db of the grinding wheel 28 is made larger, the apparatus for rotating the grinding wheel 28 at a high speed is expensive. If the rotational speed of the grinding wheel 28 is made low so as to avoid the use of the expensive apparatus, it is difficult to obtain a satisfactory grinding face. If the diameter Db of the grinding wheel 28 is made large, it is difficult for the wheel face 28*a* to be accurate.

Moreover, if the opening δ between the inner diameter saw 14*a* and the grinding wheel 28 in the radius direction is small, there is a problem in that the inner diameter saw 14*a* easily moves in the spindle direction due to the wind pressure caused by the rotation of the grinding wheel 28.

SUMMARY OF THE INVENTION

The present invention has been developed in view of the above-mentioned circumstances, and has its aim the provision of the low-priced inner diameter saw slicing machine with built-in grinder which makes smaller the diameter of the grinding wheel and the makes shorter the slicing movement distance of the ingot so that the slicing time can be short and the accuracy of the grinding plane can be satisfactory.

In order to achieve the above-described object, in the inner diameter saw slicing machine with built-in grinder of the present invention, the rotational center of the grinding wheel is eccentric to a slicing side of a slice feed direction (a direction Xa) with regard to the rotational center of the inner diameter saw.

In this case, just like the conventional machine, the grinding wheel should move in the spindle direction of the blade while rotating. The support mechanism can be constructed in the following manner.

That is, in one method (hereinafter referred to as the first method), a spindle cradle is provided through a hollow portion in a main spindle, which supports the blade rotatively, in such a manner to move in the spindle direction of the main spindle. A wheel spindle is rotatively supported by the spindle cradle, and the grinding wheel is secured to a cutting face of the wheel spindle in the blade side.

In the other method (hereinafter referred to as the second method), a spindle stock is fixed to go through the hollow portion in the main spindle. An intermediate spindle is rotatively supported by the spindle stock. A wheel spindle is provided at a spindle center of the intermediate spindle in the spindle direction of the main spindle. The grinding wheel is secured to a cutting face of the wheel spindle in the blade side.

In this case, the rotation of the wheel spindle and the intermediate spindle can be driven by an outside motor; however, a built-in motor may be constructed in the following manner.

That is, in the first method, the wheel spindle 26 is a rotor, and the spindle stock is a stator. In the second method, the intermediate spindle is a rotor, and the spindle stock is a stator.

In the slicing machine with built-in grinder according to the present invention, the rotational center of the grinding wheel is eccentric to the slicing side of the slice feed direction (a direction Xa) with regard to the rotational center of the inner diameter saw. Therefore, the opening between the inner diameter saw and the grinding wheel in the direction Xa can be smaller even if the diameter of the grinding wheel is not large. As a result, the slicing movement distance of the ingot W can be shorter.

This will be explained with reference to FIG. 1. FIG. 1(*a*) is a plane view, and FIG. 1(*b*) is a section view.

First, just as in the case of FIG. 4, which was explained in the prior art, a diameter C of the inner diameter saw 14*a* is determined from a diameter A of the ingot W and a length B in a slice base direction, so that the sliced wafer can be collected.

Next, a value γ, which is larger than a width t of the grinding wheel 28 and the wheel face 28*a* in the radius direction, is set so that the diameter Da (>A+2γ) of the grinding wheel 28 can be determined. Next, an opening a between the inner diameter saw 14*a* and the grinding wheel 28 is set so that the original position of the ingot W can be determined.

As a result, the slicing movement distance Ea of the ingot W is calculated as follows:

$$Ea=B+\alpha+\gamma$$

In this equation, just as in the case of the prior art, γ is automatically set by a width t of the grinding wheel 28 and the wheel face 28*a* in the radius direction. Therefore, the slicing movement distance Ea is determined by the opening α between the inner diameter saw 14*a* and the grinding wheel 28 in the direction Xa. In the present invention, the rotational center of the grinding wheel 28 is independent from the rotational center of the inner diameter saw 14*a*, so the opening α in the direction Xa can be set at an optional value. As a result, the opening α in the direction Xa can be small, so that the slicing movement distance Ea can be short.

In this case, even if the opening a in the direction Xa is small, an opening between the inner diameter saw 14*a* and the grinding wheel 28 in the other direction. Therefore, there is no concern that the inner diameter saw 14*a* moves in the spindle direction due to the wind pressure caused by the rotation of the grinding wheel 28, and the like.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1A:
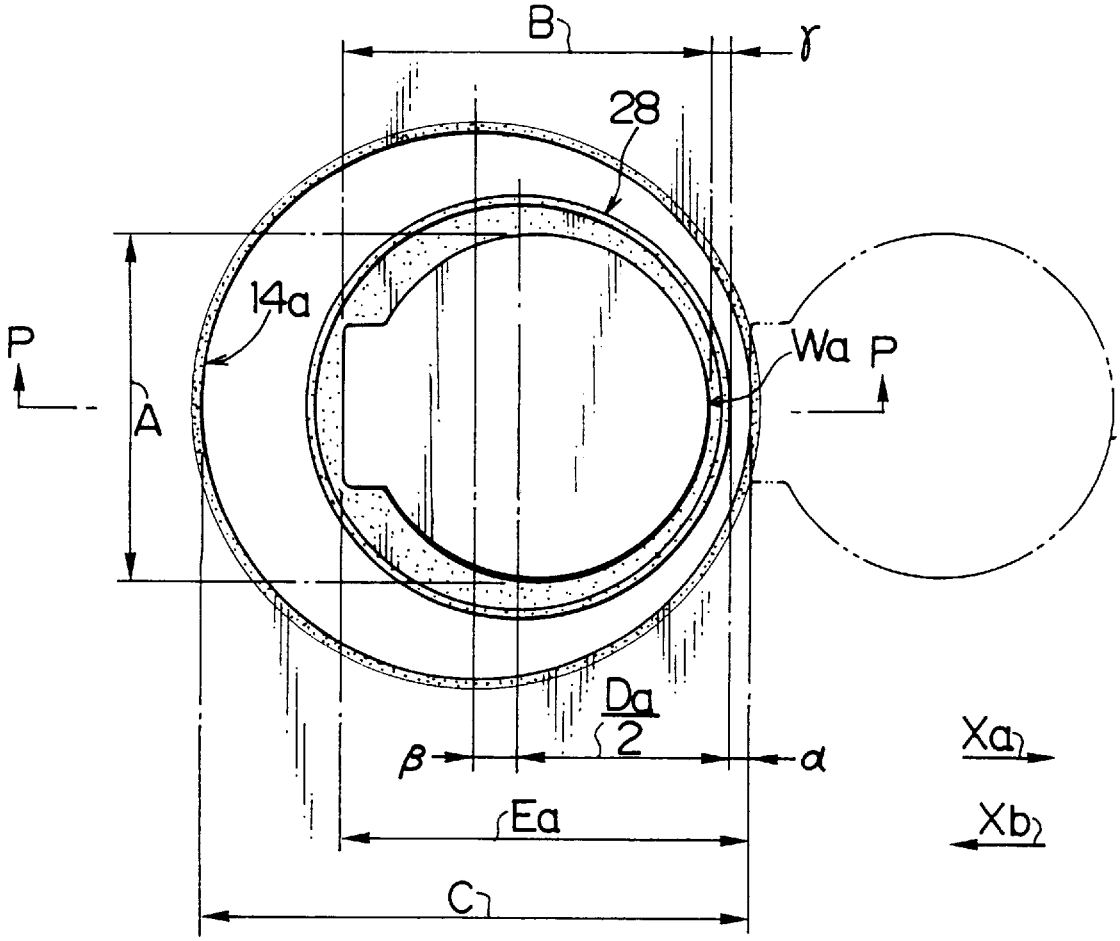
FIG. 1(*a*) is a view illustrating a inner diameter saw slicing machine with built-in grinder according to the present invention, and FIG. 1(*b*) is a section view along line P—P in FIG. 1(*a*)
Figure 1B:
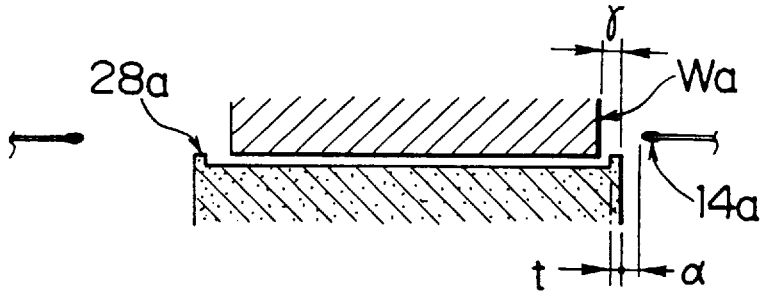
Figure 2:
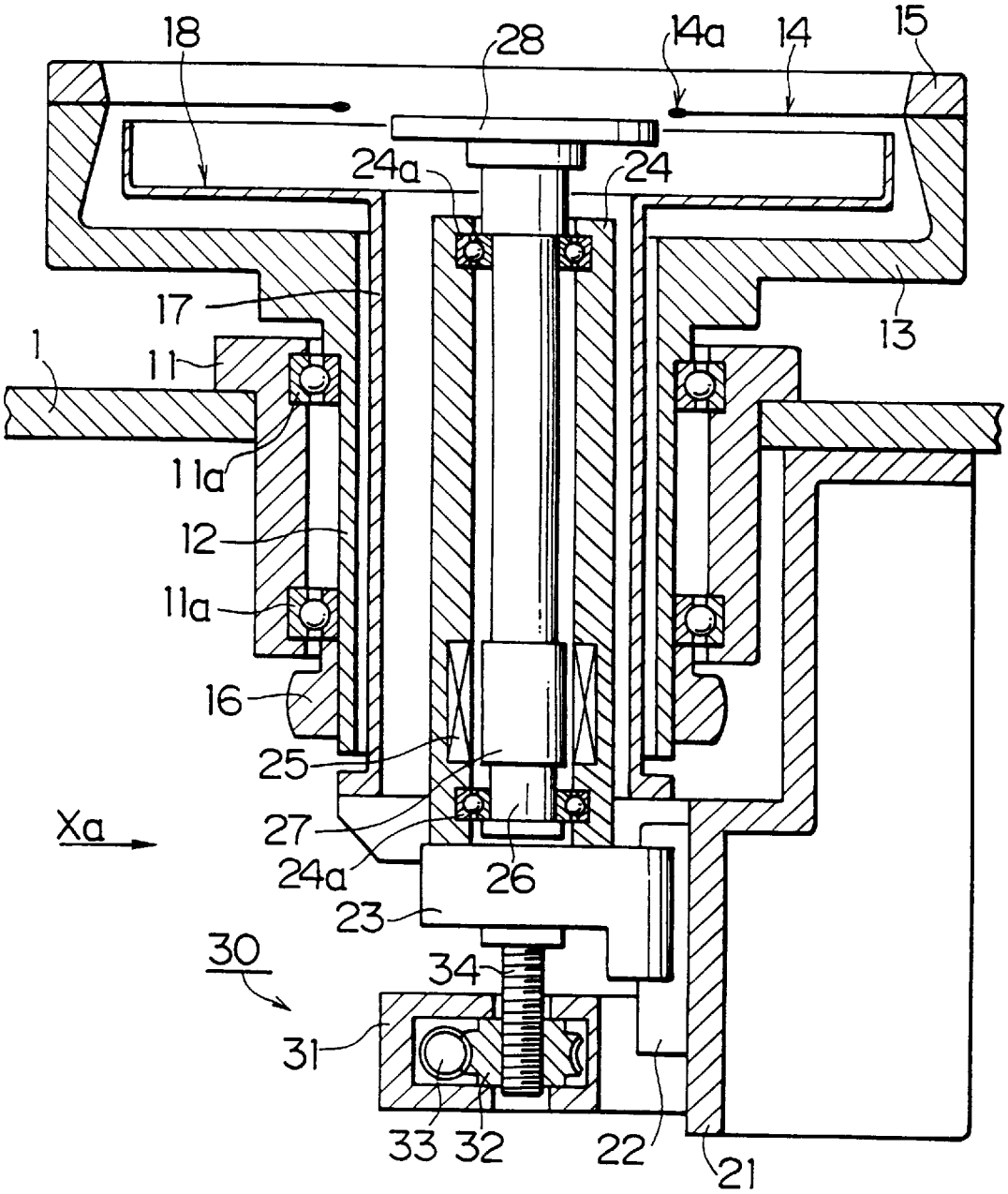
FIG. 2 is a section view illustrating the first embodiment of a grinding wheel support mechanism in the inner diameter saw slicing machine with built-in grinder according to the present invention.

FIG. 2 illustrates the first embodiment of a grinding wheel support mechanism in an inner diameter saw slicing machine with built-in grinder according to the present, invention. FIG. 2 is a section view of the same part as a manufacturing part in the vertical inner diameter saw slicing machine with built-in grinder which was explained in the prior art, and includes a support mechanism for a blade 14. A grinding wheel 28 is positioned at a top end when ground.

In FIG. 2, as described in the prior art, a housing 11 is secured to a base 1, and a main spindle 12 is rotatively supported by bearings 11*a* and 11*a*, which are stored in the housing 11. A tension head 13 is secured to a top of the main spindle 12. A blade 14 is tensioned by a top ring 15, etc., and is attached to the tension head 13. A drive pulley 16 is secured to a bottom of the main spindle 12, and connects to the spindle of a motor (not shown). Thus, the blade 14 rotates on a substantially-horizontal surface, interlocking with the rotation of the main spindle 12.

Incidentally, an inner cover 18 is secured to a top end of a column 17, which is provided at a bracket 21, which will be described later.

The bracket 21 is secured to a bottom of the base 1. A slide block 23 is supported by a linear guide 22, which is attached to the bracket 21, in such a manner to move vertically.

A spindle cradle 24 stands on the slide block 23 through a hollow portion in the main spindle 12. Bearings 24*a* and 24*a* are built in the spindle stock 24, and a wheel spindle 26 is rotatively supported by the spindle stock 24. A grinding wheel 28 is secured to a top end 26.

Furthermore, a stator 25 is provided in the spindle cradle 24, and a rotor 27 is provided in the wheel spindle 26. The stator 25 and the rotor 27 compose a built-in motor. A straight drive means 30 is provided below the slide block 23.

In the straight drive means 30, a housing 31 is provided with a worm wheel 32 and a worm 33 for driving the worm wheel 32. A screw is formed at a spindle center of the worm wheel 32, and is engaged with a feed screw 34, which is secured to the bottom of the slide block 23.

The support mechanism for the grinding wheel 28 in the first embodiment is constructed in the above-mentioned manner. The grinding wheel 28 is rotated by the built-in motor, which is composed of the stator 25 and the rotor 27. Moreover, the worm 33 is rotated by a motor (not shown) in the straight drive means 30, so that the worm wheel 32 rotates. Then, the feed screw moves vertically.

That is, the whole spindle stock 34 including the rotation mechanism moves vertically.

Figure 3:
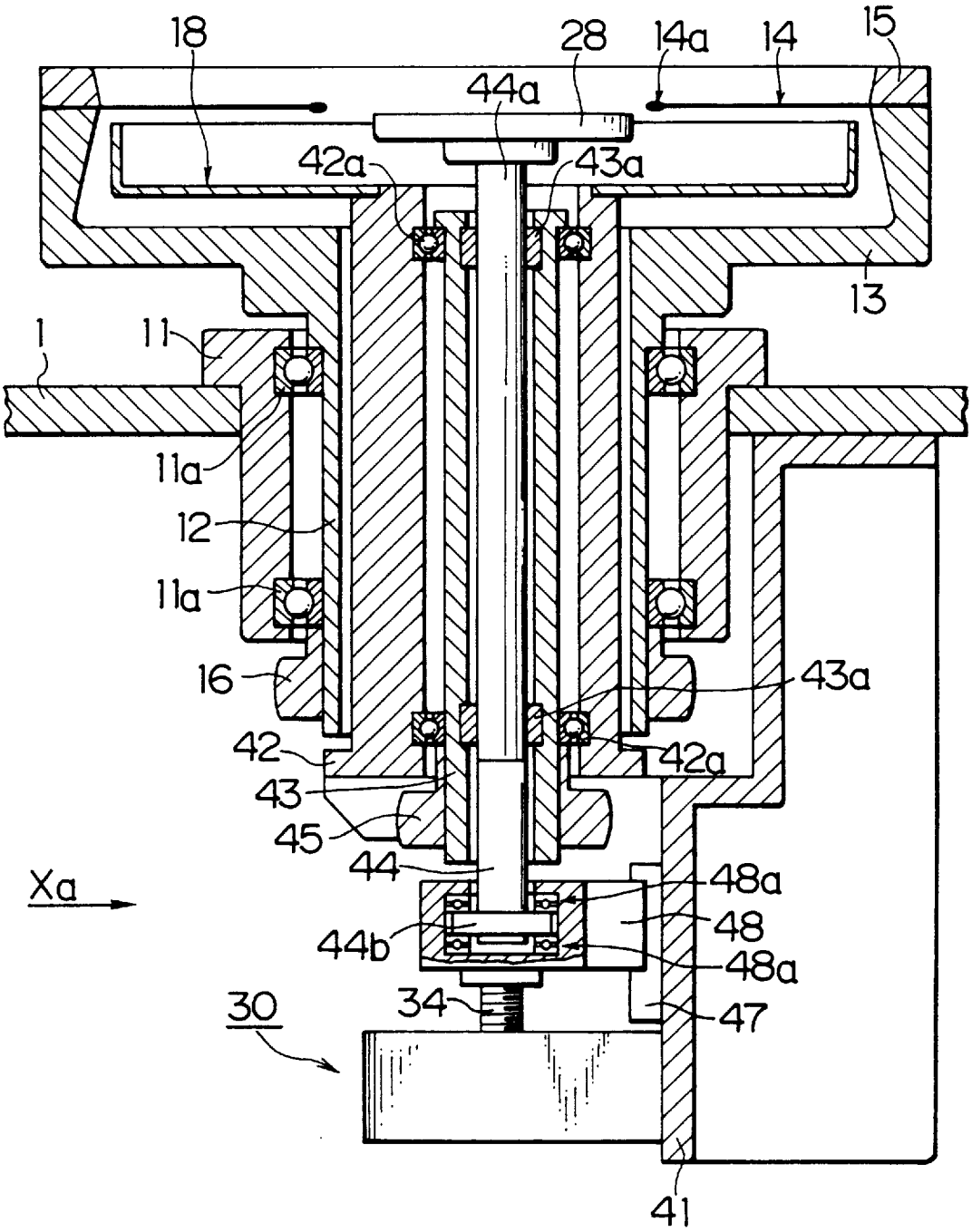
FIG. 3 is a section view illustrating the second embodiment of the grinding wheel support mechanism in the inner diameter saw slicing machine with built-in grinder according to the present invention.
Figure 4A:
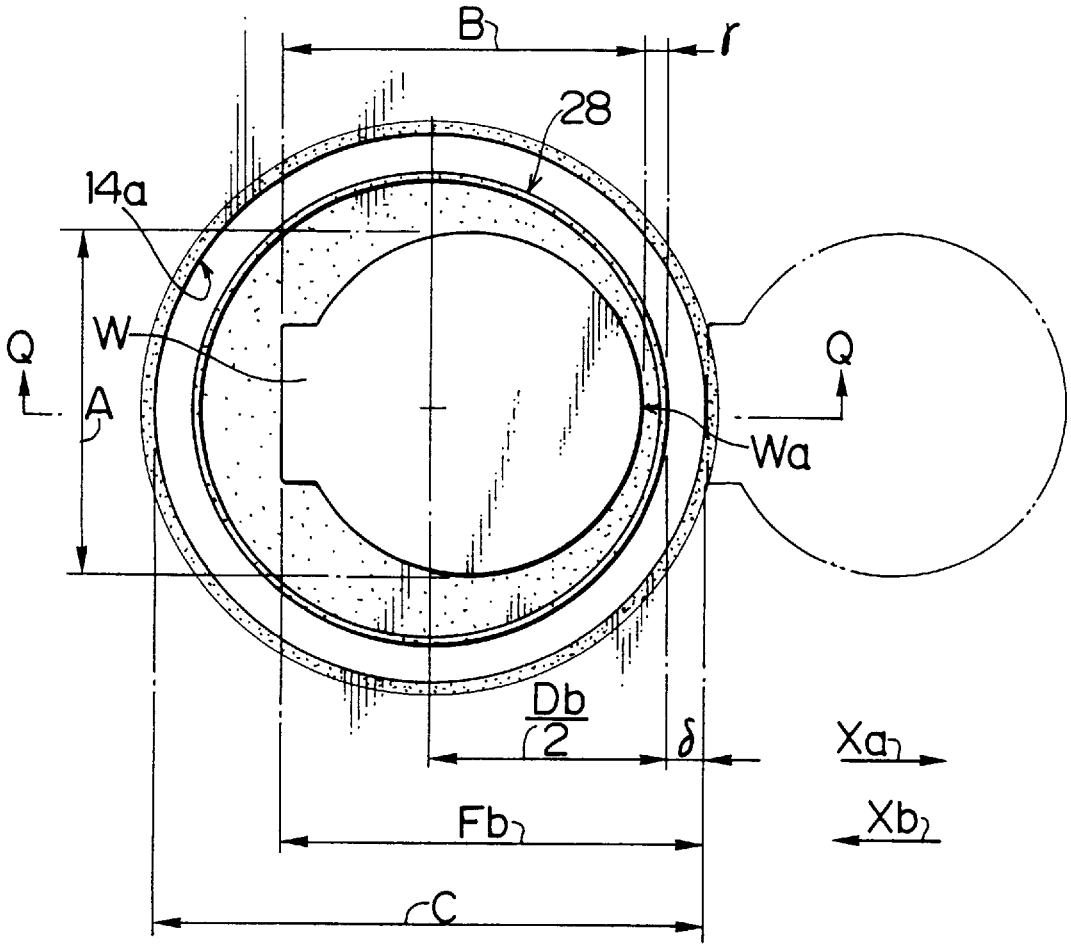
FIG. 4(a) PRIOR ART
FIG. 4(*a*) is a view illustrating the conventional inner diameter saw slicing machine with built-in grinder, and FIG. 4(*b*) is a section view along line Q—Q in FIG. 4(*a*)
Figure 4B:
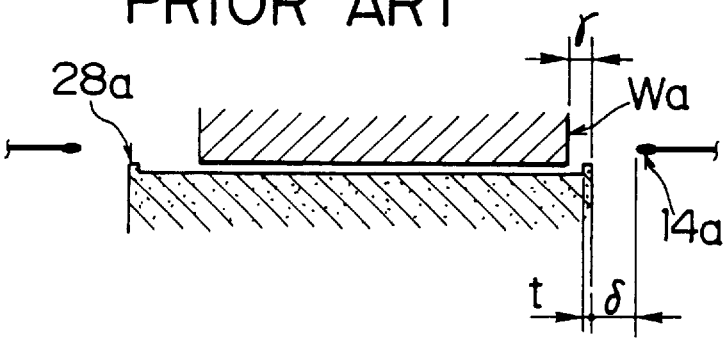
FIG. 4(b) PRIOR ART
Figure 5:
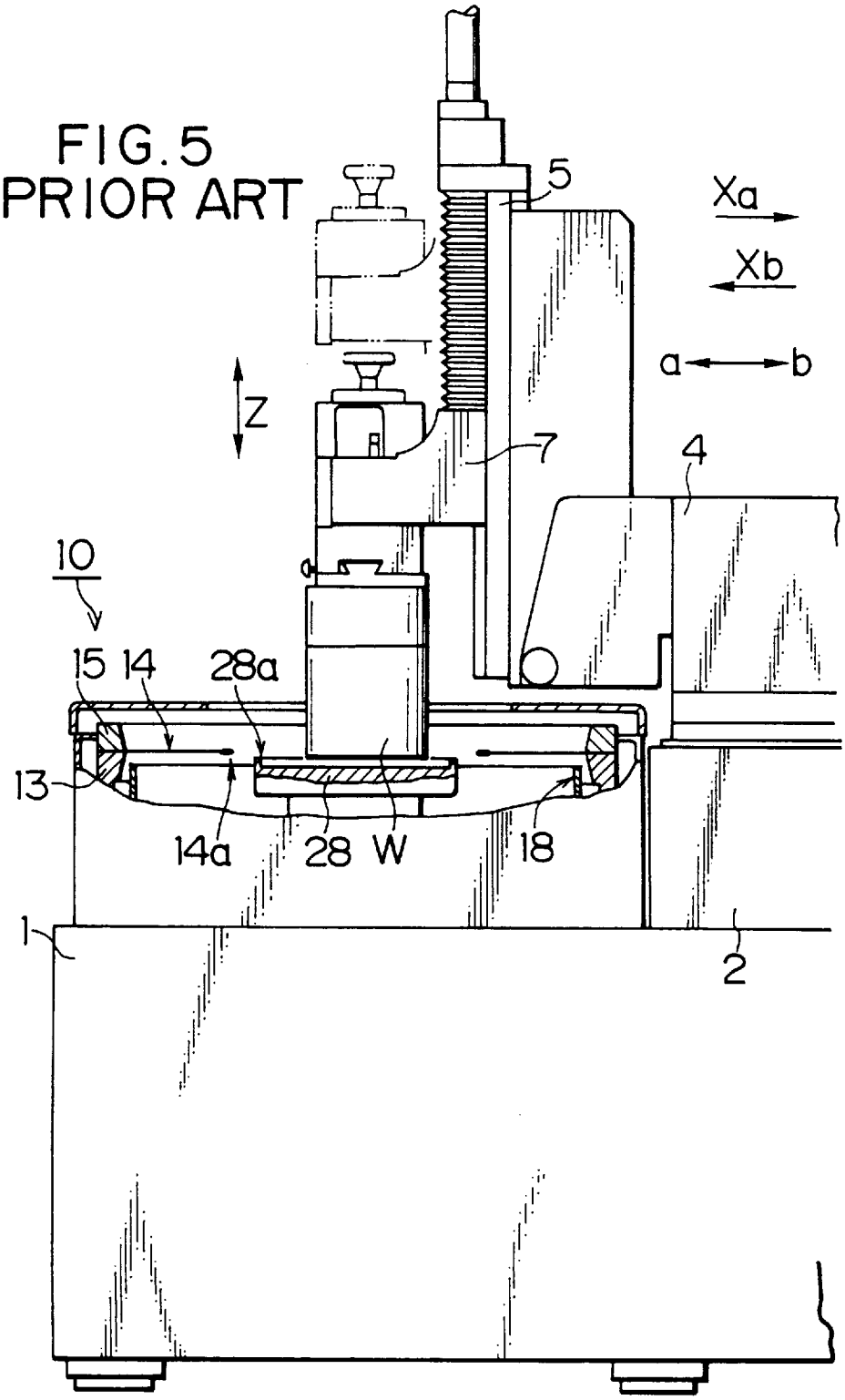
FIG. 5 PRIOR ART
FIG. 5 is an elevation illustrating essential portions of an ordinary and vertical inner diameter saw slicing machine with built-in grinder.

FIG. 3 illustrates the second embodiment of the grinding wheel support mechanism in the inner diameter saw slicing machine with built-in grinder according to the present invention. FIG. 3 is a section view of the manufacturing part as in the first embodiment, and includes a support mechanism for the blade 14. Since the support mechanism for the blade 14 is the same as that of the first embodiment, the same or similar parts are designated by the same reference characters, and an explanation about them is omitted here. The grinding wheel 28 is positioned at a top end when ground.

In FIG. 3, a bracket 41 is secured to a bottom of the base 1. A spindle stock 42 is attached to the bracket 41 through a hollow portion in the main spindle 12. Bearings 42*a* and 42*a* are built in the spindle cradle 42, and an intermediate spindle 43 is rotatively supported by the spindle stock 42. A drive pulley 45 is secured to a bottom of the intermediate spindle 43, and connects to a spindle of a motor (not shown).

Spline stocks 43*a* and 43*a* are built at the center of the intermediate spindle 43. The wheel spindle 44 is supported by the spline stocks 43*a* and 43*a* in such a manner to move in the direction of the work spindle 12. A spline 44*a* is formed at the outer diameter of the wheel spindle 44. The grinding wheel 28 is secured to a top end of the wheel spindle 44.

A slide block 48 is supported by a linear guide 47, which is attached to a bottom of the bracket 41, in such a manner to move vertically. Thrust bearings 48*a* and 48*a* are built in the slide block 48. The top and bottom of a flange 44*b*, which is formed at a bottom end of the wheel spindle 44, is supported by the thrust bearings 48*a* and 48*a*. The straight drive means 30, which was explained in the first embodiment, is provided below the slide block 48, and the feed screw 34 of the straight drive means 30 is secured to the bottom of the slide block 48.

The support mechanism for the grinding wheel 28 is constructed in the above-mentioned manner. The slide block is moved up and down by the straight drive means 30, so that the wheel spindle 44 moves vertically.

The middle spindle 43 is rotated by a drive pulley 45. When the middle spindle 43 is rotated, the wheel spindle 44 is rotated via the spline stocks 43*a* and 43*a*. In this case, the rotation is not restricted, because only the vertical movement of the bottom end of the wheel spindle is restricted.

That is, in the second embodiment, the vertical movement mechanism and the rotation mechanism are independent from each other.

Incidentally, the rotation mechanism and the vertical mechanism of the grinding wheel 28 are not limited to the above-described embodiment, and the present invention can be applied in other methods.

For example, in the first embodiment, the rotatively-driven motor is built in an opening between the spindle stock 24 and the wheel spindle 26. However, the motor may be provided outside as in the second embodiment. On the contrary, the motor is provided outside in the second embodiment; however, the motor may be built in an opening between the spindle stock 42 and the spindle 43.

As has been described above, in the inner diameter saw slicing machine with built-in grinder according to the present invention, the rotational center of the grinding wheel 28 is eccentric to the slicing side in the slice feed direction with regard to the rotational center of the inner diameter saw 14*a*.

Thus, by means of the grinding wheel 28 wherein the diameter Da is slightly larger than the diameter A of the ingot W, the grinding wheel 28 can get close to the inner diameter saw 14*a*, so that the slicing movement distance Ea of the ingot W can be short.

The comparison between the inner diameter saw slicing machine with built-in grinder according to the present invention and the conventional one will hereunder be shown by means of specific numerical values.

First, the common condition is set as follows:

The diameter A of an ingot W=200

The length B in slice base direction of an ingot W=210

The diameter C of the inner diameter saw 14*a*=310

The opening γ in the Xa direction of the ingot with regard to the grinding wheel=5

In the case of the conventional inner diameter saw slicing with built-in grinder:

when the opening δ in the radius direction of the inner diameter saw 14*a* and the grinding wheel 28=20;

The diameter Db of the grinding wheel 28=310−2×20=270

The slicing movement distance Eb of the ingot W=210+20+5=235

On the other hand, in the case of the present invention:

when the diameter Da of the grinding wheel 28=220;

the opening α in the Xa direction of the grinding wheel with regard to the inner diameter saw=5;

The slicing movement distance Ea of Ingot W=210+5+5=220

As a result, the difference (Db−Da) in the diameter of the grinding wheel 28=270−220=50 the difference (Eb−Ea) in the slicing movement distance of the ingot W=235−220=15

Moreover, the diameter Da of the grinding wheel 28 is small, so that the support mechanism can be small and therefore can be low-priced, and the accuracy of the grinding face 28*a* can be improved.

Furthermore, the total opening between the inner diameter saw 14*a* and the grinding wheel 28 (the deference between the area of the inner circle, which is formed by the inner diameter saw 14*a*, and the area of the grinding wheel 28) is large. As a result, there is little concern that the inner diameter saw 14 moves in the spindle direction due to the wind pressure, etc. caused by the rotation of the grinding wheel 28.

Therefore, because the diameter of the grinding wheel is smaller and the slicing movement distance of the ingot is short, the present invention can provide the low-priced inner diameter saw slicing machine with built-in grinder, wherein the slicing time is short and the accuracy of the grinding face is satisfactory.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. An inner diameter saw slicing machine with built-in grinder, comprising:

a doughnut-shaped blade provided with an edge formed at an inner diameter thereof and rotated for slicing an ingot into thin sheets; and a grinding wheel disposed within the blade, its rotational center being eccentric in a slice feed direction of the ingot with regard to a rotational center of the blade, the grinding wheel being rotated for grinding a cutting face of the ingot.

2. The inner diameter saw slicing machine with built-in grinder according to claim 1, wherein a rotation support mechanism of the grinding wheel comprises:

a spindle stock provided in such a manner to move in a spindle direction through a hollow portion in a main spindle which rotatively supports the blade;

a wheel spindle which is rotatively supported by the spindle stock, and wherein the grinding wheel is secured to the cutting face of the blade;

a built-in motor in which the wheel spindle is a rotor and the spindle stock is a stator; and straight drive means for the spindle stock in the spindle direction of the blade main spindle.

3. The inner diameter saw slicing machine with built-in grinder according to claim 2, wherein the straight drive means comprises:

a guide member for movably guiding the spindle stock in the spindle direction of the blade main spindle; and a feed screw mechanism for moving the spindle stock in the spindle direction of the blade main spindle.

4. The inner diameter saw slicing machine with built-in grinder according to claim 1, wherein a rotation support mechanism of the grinding wheel comprises:

a spindle stock provided through a hollow portion in a main spindle which supports the blade rotatively;

an inner spindle which is rotatively supported by the spindle stock;

a wheel spindle which is provided on a spindle center of the inner spindle in such a manner to move in a spindle direction of the blade main spindle, and wherein the grinding wheel is secured to the cutting face of the blade;

rotation drive means for driving to rotate the inner spindle; and straight drive means for driving the wheel spindle in the spindle direction of the blade main spindle.

5. The inner diameter saw slicing machine with built-in grinder according to claim 4, wherein the wheel spindle is connected to the inner spindle to rotate interlocking with the inner spindle.

6. The inner diameter saw slicing machine with built-in grinder according to claim 4, wherein the wheel spindle is splined and connected to the inner spindle by splining, and is rotated interlocking with the inner spindle, and is moved in the spindle direction with regard to the inner spindle.

7. The inner diameter saw slicing machine with built-in grinder according to claim 4, the straight drive means further comprises:

a guide member for movably guiding the wheel spindle in the spindle direction of the main blade spindle; and a feed screw mechanism for moving the wheel spindle in the spindle direction of the blade main spindle.

* * * * *